US008424779B2

(12) United States Patent
Li

(10) Patent No.: US 8,424,779 B2
(45) Date of Patent: Apr. 23, 2013

(54) VIVID WATER BLOOM SHOWER

(75) Inventor: Renzhong Li, Xiamen (CN)

(73) Assignee: Xiamen Solex High-Tech Industries Co., Ltd., Xiamen (CN)

( * ) Notice: Subject to any disclaimer, the term of this patent is extended or adjusted under 35 U.S.C. 154(b) by 55 days.

(21) Appl. No.: 13/129,622

(22) PCT Filed: Jan. 14, 2010

(86) PCT No.: PCT/CN2010/070187

§ 371 (c)(1),
(2), (4) Date: May 17, 2011

(87) PCT Pub. No.: WO2010/081420

PCT Pub. Date: Jul. 22, 2010

(65) Prior Publication Data

US 2011/0220735 A1 Sep. 15, 2011

(30) Foreign Application Priority Data

Jan. 15, 2009 (CN) ..... 2009 1 0110914
Jan. 15, 2009 (CN) ..... 2009 2 0136421 U

(51) Int. Cl.
*B05B 1/08* (2006.01)
*B05B 1/18* (2006.01)
*B05B 1/16* (2006.01)

(52) U.S. Cl.
USPC ..... 239/99; 239/69; 239/289; 239/443

(58) Field of Classification Search ..... 239/67, 239/69, 72, 99, 101, 211, 289, 380, 436, 239/443, 447–449, 556, 558, 559, 562, 563, 239/567, 583, 585.1, 587.4; 601/154, 160, 601/169
See application file for complete search history.

(56) References Cited

U.S. PATENT DOCUMENTS

| | | | | |
|---|---|---|---|---|
| 3,924,808 | A * | 12/1975 | Cooley, Jr. | 239/102.1 |
| 5,140,254 | A * | 8/1992 | Katzman | 322/35 |
| 5,467,927 | A * | 11/1995 | Lee | 239/383 |
| 6,565,018 | B1 | 5/2003 | Degeyter | |
| 7,387,401 | B2 * | 6/2008 | Clark | 362/192 |
| 2009/0040762 | A1 * | 2/2009 | Lu et al. | 362/253 |

FOREIGN PATENT DOCUMENTS

| | | | |
|---|---|---|---|
| CN | 1333706 | A | 1/2002 |
| CN | 2614090 | Y | 5/2004 |
| CN | 1803306 | A | 7/2006 |
| CN | 101183239 | A | 5/2008 |
| CN | 101249479 | A | 8/2008 |
| CN | 101518760 | A | 9/2009 |
| CN | 201361588 | Y | 12/2009 |

* cited by examiner

*Primary Examiner* — Darren W Gorman
(74) *Attorney, Agent, or Firm* — Rabin & Berdo, P.C.

(57) ABSTRACT

The invention discloses a vivid water bloom shower. An electric generator, a control circuit board and at least one electromagnetic valve are arranged in the seal area of the vivid water bloom shower, the electric generator and the electromagnetic valve are respectively electrically connected with the control circuit board; a water inlet passage, at least one normal water outlet passage and at least one rhythm water outlet passage are arranged in the water passage of the vivid water bloom shower, and the electromagnetic valve is arranged between one water inlet passage and one rhythm water outlet passage. Controlled by the control circuit board, the vivid water bloom shower can adjust water currents along with the music rhythm, thereby enabling a user to enjoy the simulated vivid scenery.

8 Claims, 3 Drawing Sheets

VIVID WATER BLOOM SHOWER

FIELD OF THE INVENTION

The present invention relates to a shower, especially relates to the vivid water bloom shower which can generate vivid water bloom in adaption with the music rhythm.

BACKGROUND OF THE INVENTION

Generally, the showers in the market are applied for generating single water stream, however, along with the development of the society, said shower with single cleaning function can not satisfy the increasing recreation needs of the consumer. Some people like to enjoy music in the bath, even some like to watch video, so if there is only monotonous sounds of water drops in bathroom, the audio-visual effect will be greatly influenced. Therefore, people eagerly need a vivid water bloom shower which can automatically adjust the water bloom according to the external environment.

SUMMARY OF THE INVENTION

The object of the present invention is to provide a vivid water bloom shower, which can solve the above drawbacks of the conventional technique. Said vivid water bloom shower can adjust water currents along with the music rhythm, thereby enabling a user to enjoy the simulated vivid scenery.

The technical solution applied by the present invention is:

Vivid water bloom shower, comprising a hollow body, a front cover fixed on the front end of said body in a sealing way, an inclined water body disposed inside the body in a sealing way and can drive the impeller rotate; a water passage and at least one seal area are arranged in said body, an electric generator, a control circuit board and at least one electromagnetic valve are arranged in said seal area; the electric generator and the electromagnetic valve are respectively electrically connected with the control circuit board; a water inlet passage, at least one normal water outlet passage and at least one rhythm water outlet passage are arranged in said water passage; each normal water outlet passage is communicated with the water outlet of the normal water outlet area disposed on said front cover; each rhythm water outlet passage is communicated with the water outlet of the rhythm water outlet area disposed on said front cover; a water inlet is disposed between the water inlet passage and the rhythm water outlet passage; and the electromagnetic valve is arranged upon the water inlet; the impeller is disposed in said water inlet passage or any of said normal water outlet passage and connected with the rod of said electric generator in an axial direction.

Said control circuit board comprises a rectifier, a voltage stabilizer, a music pulse memory, a button scanning circuit and an electromagnetic valve driving circuit; the electric generator is coaxially connected with the impeller, the electric generator provides power to the control circuit board, then the power will be orderly provided to the music pulse memory and the electromagnetic valve driving circuit through the rectifier and the voltage stabilizer.

When the shower is operated, the water will strike the impeller in the water inlet passage after flowing into an oblique spray hole of the inclined water body, then the impeller rotates rapidly to drive the electric generator rotate and generate power for the control circuit board; pressing the button to select a water output mode, so the button scanning circuit will be started by the button, then the music pulse memory selects the corresponding music, and the electromagnetic driving circuit drives the electromagnetic valve power on and power off regularly, finally the rhythm water outlet area will acquire a water outflow in adaption with the music rhythm.

A rhythm water outlet passage is disposed in said water passage, an electromagnetic valve is disposed in said seal area, and a button for controlling the working status of the electromagnetic valve is disposed on the front end of the front cover. Said button can circularly and rhythmically control the power on and power off of the electromagnetic valve, so it is convenient and simple to control the water output.

The normal water outlet area is disposed on one side of the front cover, the rhythm water outlet area is disposed on another side of the front cover; alternatively, the middle of the front cover can be arranged as normal water outlet area, the periphery of the front cover can be arranged as annular rhythm water outlet area, vice versa; or the middle and periphery of the front cover can be arranged as normal water outlet area, the annular rhythm water outlet area is disposed between the middle normal water outlet area and the peripheral normal water outlet area, vice versa.

Alternatively, the normal water outlet area and the rhythm water outlet area can be intervally arranged on the front cover.

Various kinds of water outlets can be disposed on each normal water outlet area and the rhythm water outlet area, such that the user will get more comfortable feelings.

Unless otherwise specified, the meanings of the scientific and technical terms in the present invention are similar to knowledge of those ordinary skilled in the art. Similarly, publications, patent applications and granted patents mentioned in the present invention can be used as references to the present invention.

The "front end" and the "rear end" mentioned in the present invention are set according to the direction when the shower is operated, that is the water outlet end of the shower is the "front end", the water inlet end of the shower is the "rear end". Moreover, "transversely arranged" and "vertically arranged" respectively mean the arrange direction is parallel to the water output end surface and vertical to the water output end surface.

Concluded from the above description, the present invention creatively provides a vivid water bloom shower with simple structure, said vivid water bloom shower applies its control circuit board to adjust water currents along with the music rhythm, thereby enabling a user to enjoy the simulated vivid scenery; said vivid water bloom shower further applies the impact force of the water currents to drive the impeller, because the impeller is connected with the rod of the electric generator in an axial direction, so the rod is driven to rotate and generate power, then the electric generator will provide power to the control circuit board and the electromagnetic valve, it needs no external power source; it is convenient for the user to adjust and assemble the water output modes by simply pressing the buttons on the surface of the front cover; moreover, the user will get more comfortable feelings by arranging various kinds of water outlets on each normal water outlet area and the rhythm water outlet area.

Figure 1:
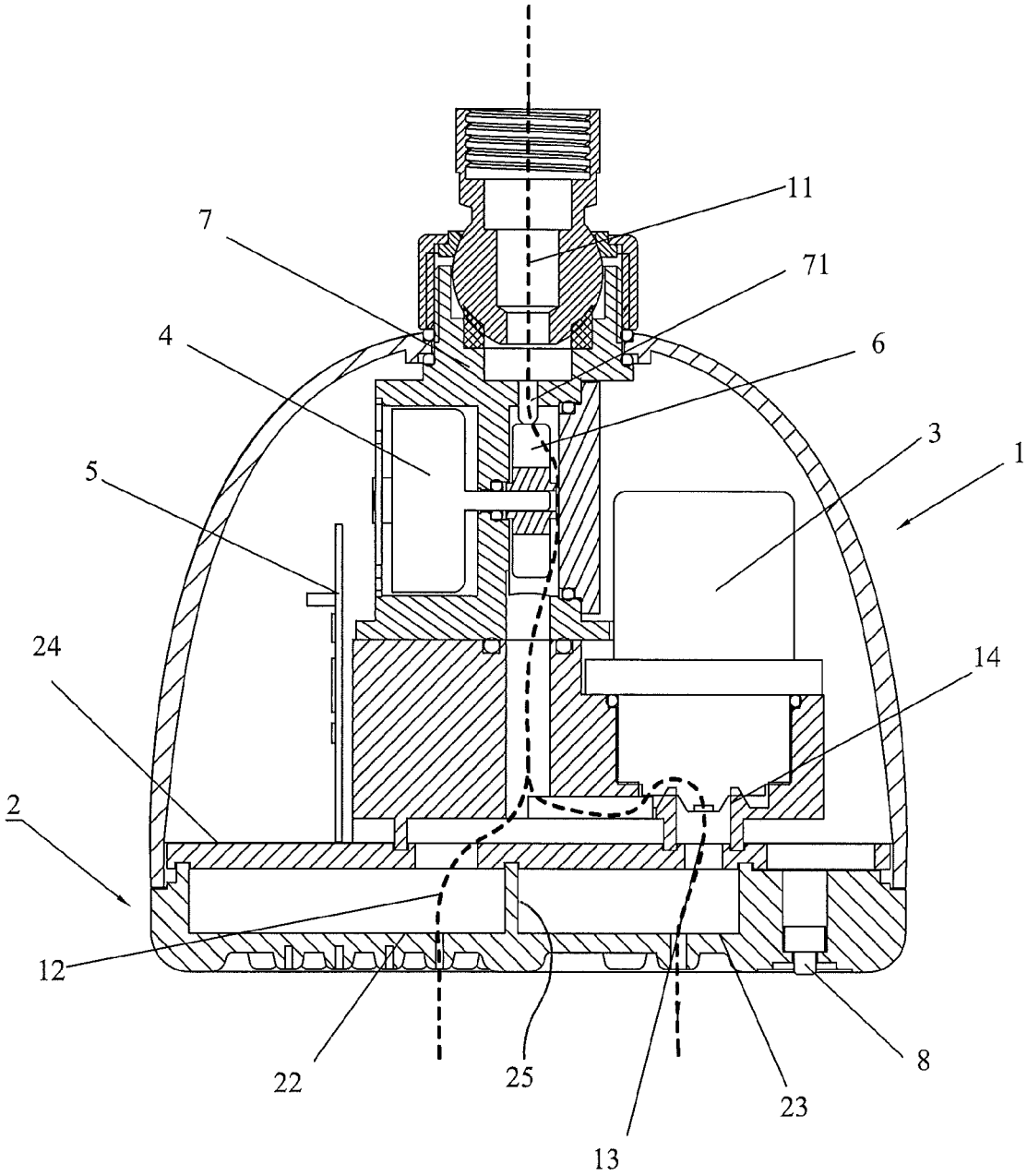
FIG. 1 is the sectional view of the shower in the first embodiment of the present invention.

Wherein, body 1, front cover, electromagnetic valve 3, electric generator 4, control circuit board 5, impeller 6, inclined water body 7, button 8, water inlet passage 11, normal water outlet passage 12, rhythm water outlet passage 13, normal water outlet area 22 and rhythm water outlet area 23.

DETAILED DESCRIPTION OF THE EMBODIMENTS

Embodiment 1, the vivid water bloom shower according to FIG. 1, comprising a hollow body 1, a front cover 2 fixed on the front end of said body 1 in a sealing way, an inclined water body 7 and an impeller 6 are disposed inside the body 1 in a sealing way; the water outlet end of an oblique spray hole 71 of the inclined water body 7 is disposed in adaption with the impeller 6, a water passage and a seal area are arranged in said body 1.

A water inlet passage 11, a normal water outlet passage 12 and a rhythm water outlet passage 13 are arranged in said water passage; the normal water outlet passage 12 is communicated with a water outlet of the normal water outlet area 22 disposed on a side of said front cover 2; a rhythm water outlet passage 13 is communicated with the water outlet of the rhythm water outlet area 23 disposed on another side of said front cover 2; a water inlet 14 is disposed between the water inlet passage 11 and the rhythm water outlet passage 13; and the electromagnetic valve 3 is arranged upon the water inlet 14; the impeller 6 is disposed in said water inlet passage 11 and connected with the rod of said electric generator 4 in an axial direction; the front cover 2 extends upward to form a separating board 25, the front cover 2, the separating board 25 and a covering board 24 define a normal water outlet area 22 and a rhythm water outlet area 23.

A button 8 is electrically connected with the control circuit board and disposed on the front end of the front cover 2. Said button 8 can circularly control the power on and power off of the electromagnetic valve, so the water output is controllable.

Figure 3:
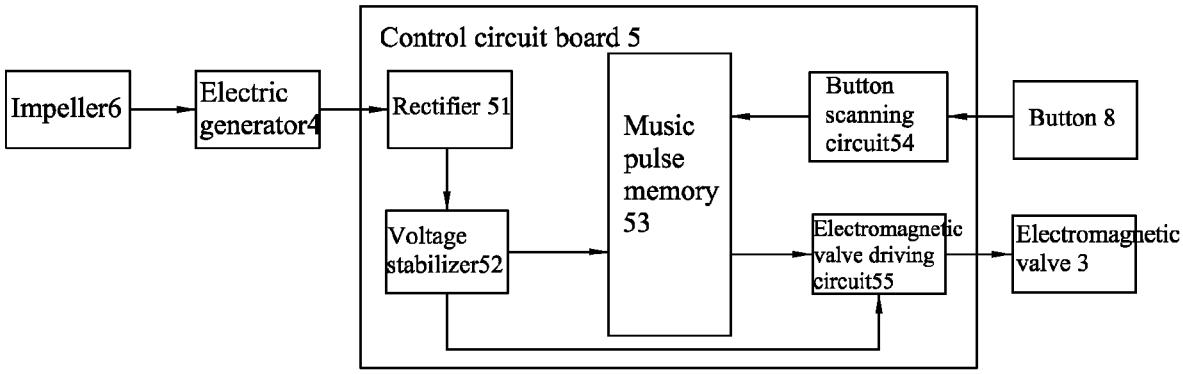
FIG. 3 is the function-block diagram of the embodiment of the present invention.

The seal area is equipped with an electric generator 4, a control circuit board 5 and an electromagnetic valve 3, the electric generator 4 and the electromagnetic valve 3 are both electrically connected with the control circuit board 5, as showed in FIG. 3, said control circuit board 5 comprises a rectifier 51, a voltage stabilizer 52, a music pulse memory 53, a button scanning circuit 54 and an electromagnetic valve driving circuit 55; the electric generator 4 is coaxially connected with the impeller 6, the electric generator 4 provides power to the control circuit board 5, then the power will be orderly provided to the music pulse memory 53 and the electromagnetic valve driving circuit 55 through the rectifier 51 and the voltage stabilizer 52. The electromagnetic valve 3 is impulse type; the music pulse memory 53 is saved with music pulse.

Preferably, various kinds of water outlets can be disposed on the normal water outlet area 22 and the rhythm water outlet area 23, such that the user will get more comfortable feelings.

When the shower is operated, the water will strike the impeller 6 in the water inlet passage or in the normal water outlet passage after flowing into an oblique spray hole 71 of the inclined water body 7, then the impeller 6 rotates rapidly, because the impeller 6 is connected with the rod of the electric generator 4 in an axial direction, so the rod of the electric generator 4 will be driven to rotate and generate power for the control circuit board 5; the user can select the required water output mode by pressing the button 8, so the button scanning circuit 54 will be started by the button 8, then the music pulse memory 53 selects the corresponding music, and the electromagnetic driving circuit 55 drives the electromagnetic valve 3 power on and power off regularly, finally the rhythm water outlet area will acquire a water outflow in adaption with the music rhythm.

Figure 2:
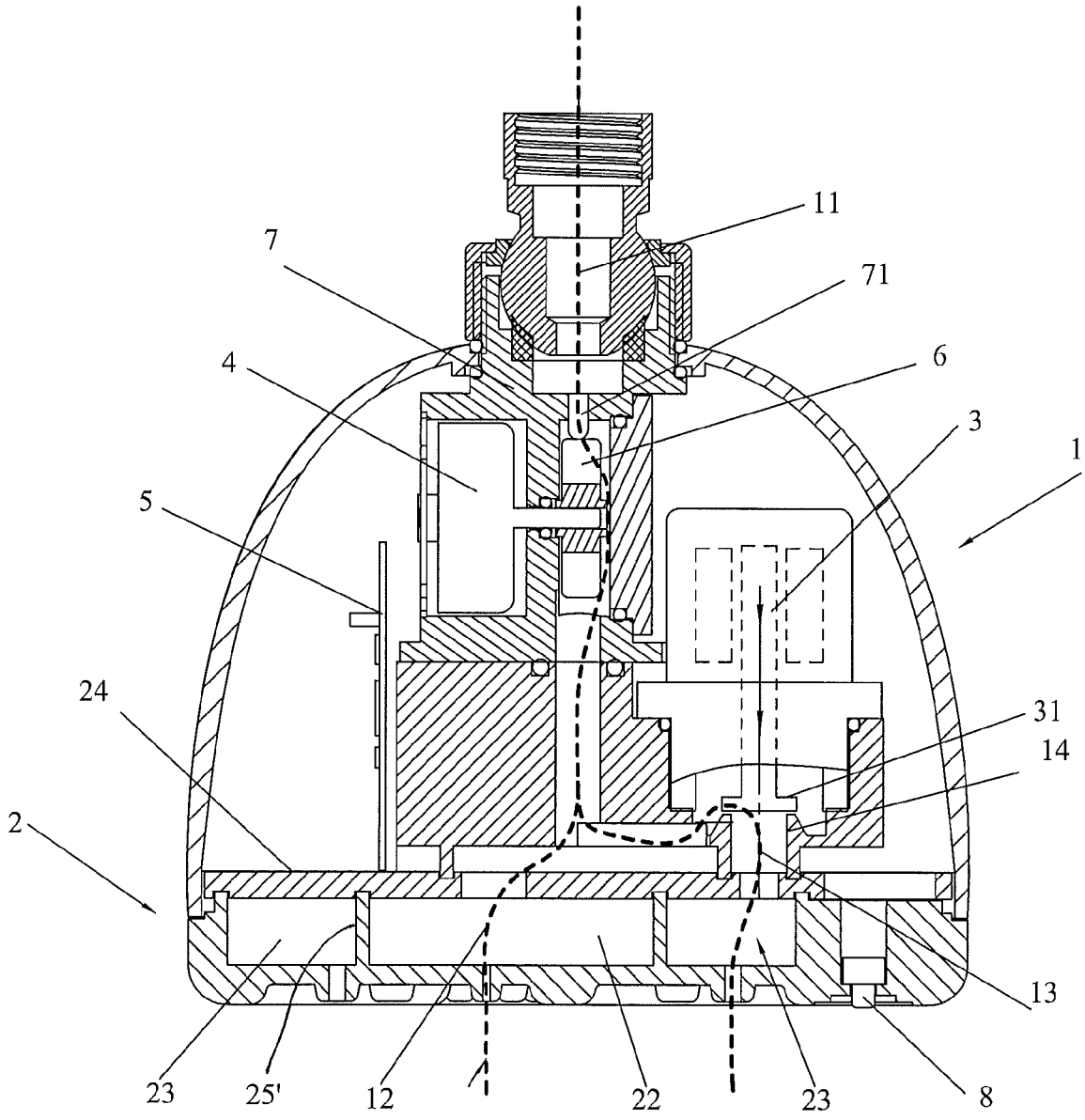
FIG. 2 is the sectional view of the shower in the second embodiment of the present invention.

Embodiment 2, a vivid water bloom shower according to FIG. 2, the difference between the embodiment 1 and the embodiment 2 is the distribution of the rhythm water outlet area; the front cover 2 extends upward to form a ring of separating board 25', the front cover 2, the separating board 25' and the covering board 24 defines a circular normal water outlet area 22 and a annular rhythm water outlet area 23 surrounding the normal water outlet area 22. A water inlet 14 is disposed on the rhythm water outlet passage, the electromagnetic valve 3 is disposed upon the water inlet 14; the spool 31 of the electromagnetic valve 3 is adapted to the shape of the water inlet 14, it moves up and down to control the water outlet passage 13 to be opened or closed.

Alternatively, the rhythm water outlet area of the vivid water bloom shower of the present invention can be distributed in other manners, for example, a rhythm water outlet area is disposed on the middle of the front cover, an annular normal water outlet area is disposed around said rhythm water outlet area.

Alternatively, there can be two normal water outlet areas respectively disposed on the middle and the periphery of the front cover, while the annular rhythm water outlet area is set between the middle normal water outlet area and the peripheral normal water outlet area; or two rhythm water outlet areas respectively disposed on the middle and the periphery of the front cover, while the annular normal water outlet area is set between the middle rhythm water outlet area and the peripheral rhythm water outlet area.

Although the present invention has been described with reference to the preferred embodiments thereof for carrying out the invention, it is apparent to those skilled in the art that a variety of modifications and changes may be made without departing from the scope of the present invention which is intended to be defined by the appended claims.

INDUSTRIAL APPLICABILITY

The vivid water bloom shower of the present invention, wherein an electric generator, a control circuit board and impulse-type electromagnetic valve are arranged in its seal area; the impulse-type electromagnetic valve is driven by the control circuit board, so the vivid water bloom shower can adjust water currents along with the music rhythm, thereby enabling a user to enjoy the simulated vivid scenery.

What is claimed is:

1. A vivid water bloom shower, comprising:

a hollow body having a water passage therein and at least one seal area therein, a water inlet passage, at least one normal water outlet passage and at least one rhythm water outlet passage being arranged in the water passage;

an impeller disposed inside said hollow body and in the water inlet passage;

a front cover fixed on a front end of said body in a sealing manner;

an inclined water body disposed inside the body in a sealing manner for driving the impeller to rotate;

a control circuit board disposed in the seal area;

an electric generator disposed in the seal area and being electrically connected to said control circuit board the impeller being connected with a rod of said electric generator in an axial direction; and at least one electromagnetic valve disposed in the seal area and being electrical connected to said control circuit board;

wherein each normal water outlet passage is communicated with a water outlet of a normal water outlet area disposed on said front cover;

each rhythm water outlet passage is communicated with a water outlet of a rhythm water outlet area disposed on said front cover; and a water inlet is disposed between the water inlet passage and the rhythm water outlet passage, the electromagnetic valve being arranged upon the water inlet.

2. The vivid water bloom shower according to claim 1, wherein said control circuit board comprises a rectifier, a voltage stabilizer, a music pulse memory, a button scanning circuit and an electromagnetic valve driving circuit; the electric generator being coaxially connected with the impeller the electric generator providing power to the control circuit board, and the power being orderly provided to the music pulse memory and the electromagnetic valve driving circuit through the rectifier and the voltage stabilizer.

3. The vivid water bloom shower according to claim 2, wherein the water strikes the impeller in the water inlet passage after flowing into an oblique spray hole of the inclined water body, causing the impeller to rotate rapidly to drive the electric generator to rotate and generate power for the control circuit board; and wherein a button is pressable to select a water output mode, to start the button scanning circuit, causing the music pulse memory to select a corresponding music, and causing the electromagnetic valve driving circuit to drive the electromagnetic valve to power on and power of regularly, with the rhythm water outlet area acquiring a water outflow in sync with a music rhythm.

4. The vivid water bloom shower according to claim 1, wherein said electromagnetic valve is an impulse type.

5. The vivid water bloom shower according to claim 1, wherein a button for controlling the electromagnetic valve is disposed on a front end of the front cover.

6. The vivid water bloom shower according to claim 5, wherein the normal water outlet area is disposed on one side of the front cover, and the rhythm water outlet area is disposed on another side of the front cover.

7. The vivid water bloom shower according to claim 5, wherein the normal water outlet area is disposed on a middle of the front cover, and the rhythm water outlet area is annular and is disposed around said normal water outlet area.

8. The vivid water bloom shower according to claim 2, wherein said electromagnetic valve is an impulse type.

* * * * *